US007367549B2

(12) United States Patent
Titmus

(10) Patent No.: US 7,367,549 B2
(45) Date of Patent: May 6, 2008

(54) SAFETY BARRIER ANCHORAGE

(75) Inventor: Michael Thomas Titmus, Brierley Hill (GB)

(73) Assignee: Hill & Smith Limited (GB)

( * ) Notice: Subject to any disclaimer, the term of this patent is extended or adjusted under 35 U.S.C. 154(b) by 183 days.

(21) Appl. No.: 11/213,606

(22) Filed: Aug. 26, 2005

(65) Prior Publication Data

US 2006/0043353 A1 Mar. 2, 2006

(30) Foreign Application Priority Data

Aug. 27, 2004 (GB) ..... 0419185.4

(51) Int. Cl.
*E01F 15/00* (2006.01)

(52) U.S. Cl. ..... 256/13.1; 404/6; 404/10

(58) Field of Classification Search ..... 256/13.1; 404/6, 9, 10

See application file for complete search history.

(56) References Cited

U.S. PATENT DOCUMENTS

| | | | | |
|---|---|---|---|---|
| 1,857,435 | A * | 5/1932 | Cole | 256/13.1 |
| 1,913,715 | A | 6/1933 | MacDonald | |
| 2,265,698 | A * | 12/1941 | Opgenorth | 256/13.1 |
| 2,440,574 | A | 4/1948 | Cotton | 244/110 |
| 3,307,833 | A | 3/1967 | Muller et al. | 256/13.1 |
| 3,332,666 | A * | 7/1967 | Gray | 256/13.1 |
| 3,351,322 | A * | 11/1967 | Mueller | 256/13.1 |
| 3,353,795 | A | 11/1967 | Muller | 256/13.1 |
| 3,417,965 | A * | 12/1968 | Gray | 256/13.1 |
| 4,819,915 | A * | 4/1989 | Cargnel | 256/13.1 |
| 6,065,738 | A | 5/2000 | Pearce et al. | 256/13.1 |
| 6,488,268 | B1 * | 12/2002 | Albritton | 256/13.1 |
| 6,962,328 | B2 * | 11/2005 | Bergendah | 256/13.1 |
| 2003/0222254 | A1 | 12/2003 | Bergendahl | 256/13.1 |

FOREIGN PATENT DOCUMENTS

| | | |
|---|---|---|
| EP | 0 369 659 A1 | 5/1990 |
| EP | 0 845 558 A2 | 6/1998 |
| GB | 1043561 | 9/1966 |
| GB | 1242541 | 8/1971 |
| GB | 1 417 109 | 12/1975 |

* cited by examiner

*Primary Examiner*—Robert J. Sandy
*Assistant Examiner*—Michael P Ferguson
(74) *Attorney, Agent, or Firm*—Tomlinson & O'Connell, PC

(57) ABSTRACT

A road safety barrier comprising a series of posts rigidly mounted on or in the ground, an anchor body (9) fixed in or on the ground beyond the series of posts, and at least one rope (1-4) which is supported by the posts so as to extend along the series of posts and which has an end portion (8) extending downwards from the last post (6*a*) of the series towards the anchor body (9). A terminal (19) is fixed on the extremity (8*e*) of the end portion (8) of the rope. An elongate tie bar 21 has a first end part connected to the anchor body (9) and a second end part releasably connected to the terminal (19) so that the elongate tie bar is in line with the terminal and the end portion (8) of the rope. The tie bar (21) reduces the risk of damage to the terminal (19) in the event of vehicular impact, and is easily replaceable. It also facilitates disengagement of the rope from the anchor body (9) if a vehicle becomes trapped 1o the end portion (8) of the rope during a collision.

10 Claims, 3 Drawing Sheets

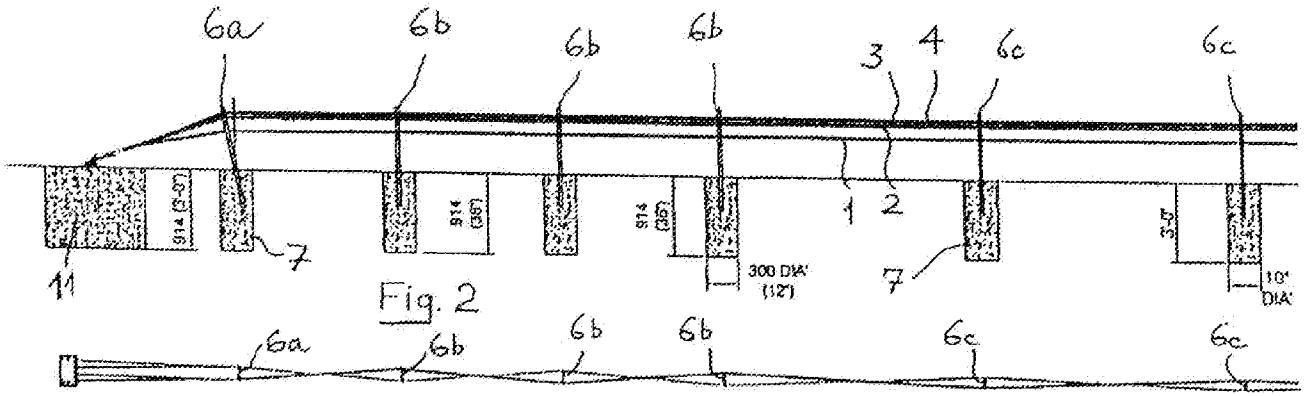
Fig. 2
Fig. 3
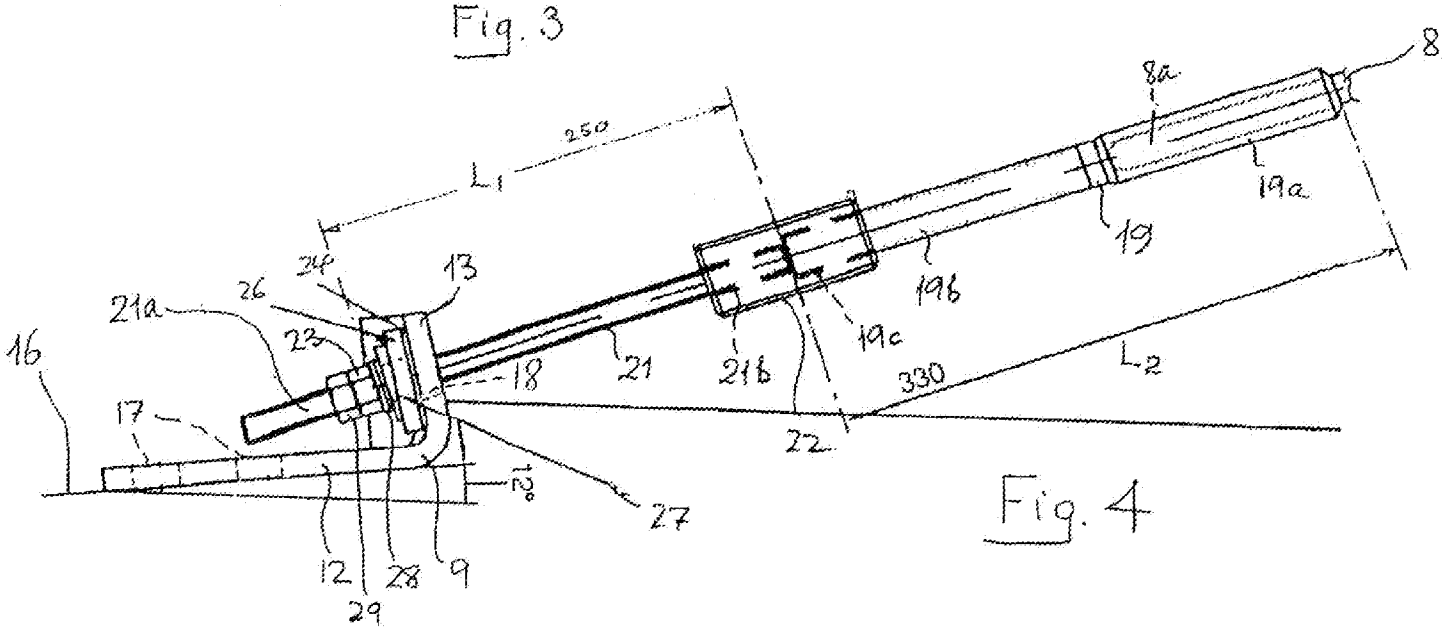
Fig. 4

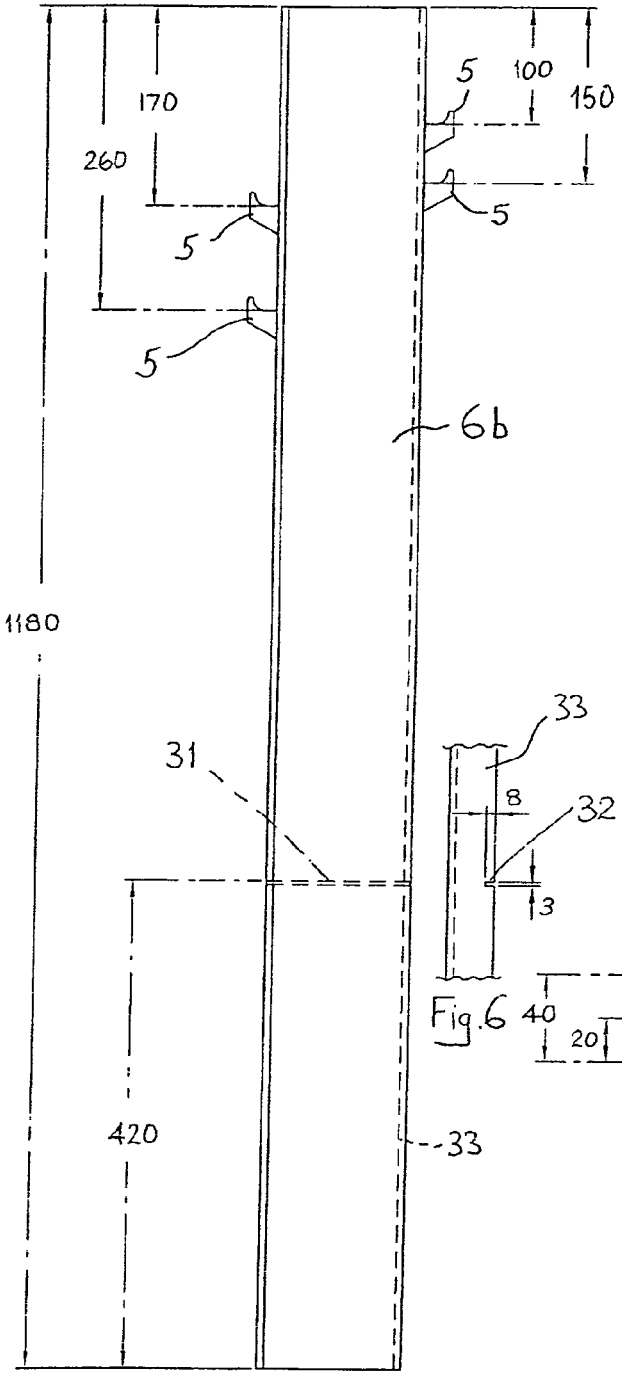
Fig. 5
Fig. 6
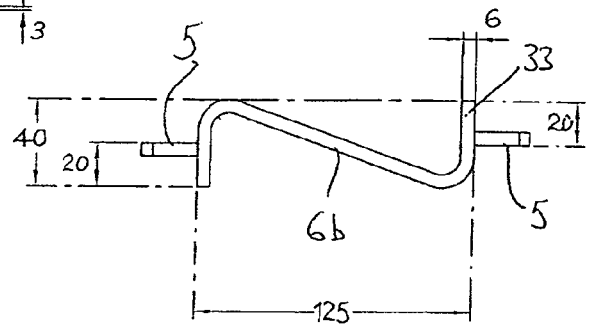
Fig. 7

SAFETY BARRIER ANCHORAGE

CROSS REFERENCE TO RELATED APPLICATIONS

This application claims priority of United Kingdom Patent Application No. 0419185.4, filed Aug. 27, 2004.

FIELD OF THE INVENTION

This invention relates to road safety barriers. In particular, the invention relates to a road safety barrier including a rope and to the anchoring of one end of the rope to the ground.

SUMMARY OF THE INVENTION

U.S. Pat. No. 6,065,738 discloses several embodiments of a road safety barrier comprising a series of posts rigidly mounted on or in the ground, an anchor body fixed in or on the ground beyond the series of posts, at least one rope which is supported by the posts so as to extend along the series of posts and which has an end portion extending downwards from the last post of the series towards the anchor body, and a terminal fixed on the extremity of the end portion of the rope. In each embodiment the terminal is connected directly to the anchor body. When a vehicle collides with the rope, particularly with the downwardly sloping end portion of the rope, there is a risk of damage to the terminal and the part of the rope in or adjacent the terminal. Such damage may necessitate replacement of the terminal and/or the rope, which is an expensive operation.

In some embodiments described in U.S. Pat. No. 6,065,738 the terminal is intended to become detached from the anchor body in the event of a collision. However, it has been found that the flexibility of the rope may allow a vehicle to be trapped by the downwardly extending portion without the terminal being disengaged from the anchor body.

In the barriers described in U.S. Pat. No. 6,065,738 all the posts are vertical. The last post is thus subjected to a bending moment, about its mounting point, by the downwardly sloping end portion of the rope, being under tension. This limits the tension which can be applied to the rope. Furthermore, when a vehicle collides with the rope, at any point but particularly at the end portion, this may apply an excessive bending moment to the last post, permanently damaging it.

In one aspect the present invention provides a road safety barrier including an elongate member or tie bar having a first end part connected to the anchor body and a second end part releasably connected to the terminal so that the elongate member or tie bar is in line with the terminal and the end portion of the rope.

In another aspect the invention provides a road safety barrier in which the last post is inclined from the vertical towards the anchor body.

In another aspect the invention provides a road safety barrier in which the last post is weakened at or near ground level.

The invention will be described further, by way of example only, with reference to the accompanying drawings, in which:

BRIEF DESCRIPTION OF THE DRAWINGS

FIG. 2 is a side elevation of the road safety barrier;

FIG. 3 is a plan view of the road safety barrier;

FIG. 4 is an enlarged detail of the anchorage shown in FIG. 1;

FIG. 5 shows a post;

FIG. 6 is a fragmentary side elevation of the post; and

FIG. 7 is a plan view of the post.

DESCRIPTION OF THE PREFERRED EMBODIMENTS

Figure 1:
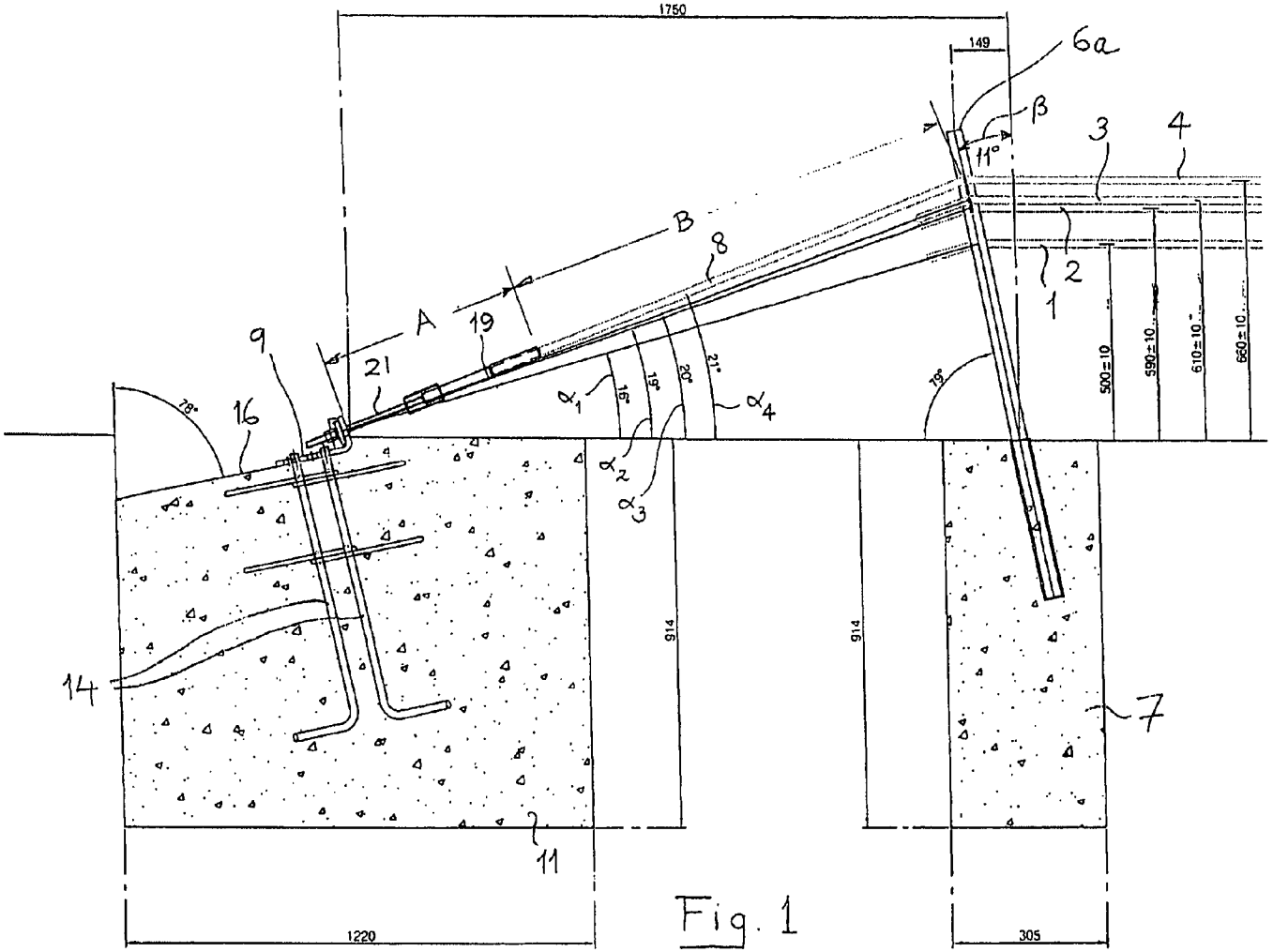
FIG. 1 is a diagrammatic vertical section through an anchorage at one end of a road safety barrier in accordance with the invention.

The safety barrier illustrated in FIGS. 1 to 4 extends parallel to the direction of traffic flow, at one side of a road or between two carriageways. Only one end of the safety barrier is shown; the other end may be similar or different in design. Steel wire ropes 1-4 (for example, four in number) are supported by a series of posts 6*a-c* loosely fitted in steel sockets that are rigidly mounted in concrete footings 7 in the ground. (Alternatively, the posts could have bases bolted to plates fixed to the footings or could be rigidly mounted in the footings.) In the preferred embodiment illustrated, each rope follows a sinuous path along the series of posts, in particular passing from one side to the other of adjacent posts, as best seen in FIG. 3. The ropes are supported, for example, by rollers or hooks on the posts, in particular being supported by hooks 5 on the last post 6*a* and adjacent posts 6*b* and by rollers on the other posts 6*c*. Each rope is under tension and extends horizontally between the posts. The spacing between the posts 6*a*, 6*b* nearer the end of the safety barrier is less than that between the other posts 6*c*.

The end portion 8 of each rope extends downwards from the last post 6 towards an anchor body 9 which is fixed on a concrete foundation 11 beyond the end of the series of posts 6*a-c*. The anchor body 9 is approximately L-shaped in side view; it comprises a base plate 12 and an upstanding flange 13. The threaded upper ends of several (e.g. four) anchoring rods 14 project from a sunken sloping upper surface 16 of the foundation 11 and through holes 17 in the base plate 12, and nuts (not shown) are applied to the threaded ends to secure the anchor body 9 to the foundation 11. The flange 13 has four upwardly open slots 18 and is tilted away from the series of posts 6*a-c*.

An elongate terminal 19 comprises a hollow portion 19*a*, which is fixed on the extremity 8*a* of the end portion 8 of a respective rope, and a solid elongate portion 19*b* provided with a screwthread 19*c*. The hollow portion 19*a* is swaged on the rope extremity 8*a*. The terminal 19 is made of steel, for example, having suitable flow characteristics for the swaging process and having a sufficiently high tensile strength to withstand the high tensile loads to which it is subjected under normal conditions of impact of a vehicle with the safety barrier.

An elongate member or tie bar 21 has a first end part 21*a* connected to the anchor body 9 and a second end part 21*b* releasably connected to the terminal 19. In the preferred embodiment illustrated, the end part 21*b* carries a connecting member or socket 22 which is threaded on the screwthread 19*c* of the terminal 19. In the preferred embodiment, as shown, the socket 22 is also threaded on the end part 21*b* of the tie bar 21. (Alternatively, the socket could be integral with the tie bar or the terminal.) The end part 21*a* of the tie bar 21 extends through a respective slot 18 in the flange 13 of the anchor body 9. The flange 13 provides a first abutment surface facing away from the series of posts 6*a-c*, and a tensioning nut 23 (threaded on the end part 21*a* of the tie bar 21) provides a second abutment surface facing the first abutment surface. Between the first and second abutment surfaces there is a series of intermediate members, comprising, in sequence, a plastics (e.g. nylon) washer 24, a metal plate 26 (having a through-hole), a tapered metal washer 27, and at least one plain metal washer 28 (two shown). The tensioning nut 23 is tightened to provide the required tension in the rope, and a locking nut 29 is then tightened against it.

If a rope gets jammed over a wheel or other part of a vehicle, as the vehicle approaches the anchor body 9 the rope will be lifted up, increasing the angle between the rope and the ground and causing the end part 21*a* of the tie bar 21 to slide up in the slot 18 and eventually disengage completely from the anchor body 9. During this process, damage is likely to occur to the tie bar 21. However, it is easy and inexpensive to replace a damaged tie bar. The tie bar 21 (or at least a part of it between the anchor body 9 and the end part 21*b*) has a cross-sectional area less than the minimum cross-sectional area of the terminal 19; this helps to ensure that the tie bar 21 will fail in preference to the terminal 19. For the same reason, the bending strength of the tie bar 21 is less than that of the terminal 19. In the embodiment illustrated, the working length $L_1$ (e.g. 250 mm) of the tie bar 21 (the length under tension, between the tensioning nut 23 and the terminal 19) is about three-quarters of the length $L_2$ (e.g. 330 mm) of the terminal 19; for example, $L_1$ may be from about one half to several times $L_2$. In general it will be convenient for the working length of the tie bar to be about the same as the length of the terminal.

Preferably, the free length B of rope between the last post 6*a* and the terminal 19 is at least twice the distance A between the anchor body 9 and the end of the terminal 19 remote from the anchor body. The ratio B/A may be up to three (or more), but the elongate tie bar 21 should be of sufficient length to prevent risk of damage to the terminal 19. The tie bar 21, the terminal 19, and the end portion 8 of the corresponding rope are in line and at an angle $\propto$ to the horizontal. By way of example, as shown in FIG. 1, $\propto_1=16°$ (rope 1), $\propto_2=19°$ (rope 2), $\propto_3=20°$ (rope 3), and $\propto_4=21°$ (rope 4). To minimize (or at least reduce) the bending moment applied to the last post 6*a* by the ropes 1-4 passing over it and sloping down towards the amber body 9, the last post is inclined at an angle $\beta$ from the vertical towards the anchor body 9 (whereas the other posts 6*b*, 6*c* are vertical). Ideally $\beta$ is about half $\propto$. In general terms, $\beta=(\propto/2)\pm\delta$, where $\delta$ is a tolerance, which may be up to 5° (or more), up to 4°, or preferably up to 3°.

It will be appreciated that the interposition of the elongate member or tie bar 21 between the terminal 19 and the anchor body 9 facilitates disengagement from the anchor body in the event of impact, avoids or reduces the risk of damage to the rope in such an event, and provides an easily replaceable link. The tie bar 21 is relatively rigid in comparison with the rope, which of course comprises helically wound wires. The tie bar 21 and the terminal 19, in combination, provide a long rigid section which is substantially stiffer in bending than the rope itself and which thereby facilitates detachment from the anchor body 9 in the event of a vehicle collision.

The tie bar 21 may therefore be considered to be a tensile or mechanical fuse designed to fail in preference to the terminal 19, and to reduce the risk of damage to the rope, when a vehicle collides with the safety barrier.

The open-ended slot 18 in the flange 13 of the anchor body 9 serves as a disengagement device allowing the tie bar 21 to separate from the anchor body (in a direction parallel to the abutment surface of the flange 13) in response to a predetermined deflection of the end portion 8 of the corresponding rope. Alternative disengagement devices may be used. In particular, a shearing edge may be provided in such a position that the tie bar is contacted by the shearing edge and fractures under tension when the end portion 8 of the rope is subjected to the predetermined deflection.

To ensure that the posts 6*a*, 6*b* nearest the end of the safety barrier inevitably collapse by folding in a predictable manner, they are each weakened at or near ground level. In particular, as shown in FIGS. 5 and 6, taking one of the posts 6*b* as an example, a weakened portion is provided at a transition 31 between the lower part of the post 6*b* (fitted in the above-mentioned socket) and the exposed upper part. Preferably, as shown in FIG. 6, the weakened portion comprises a notch 32 in the side of the post facing the oncoming traffic, in particular in a flange 33 directed towards the oncoming traffic. At least the post 6*a* is weakened in this way.

The invention claimed is:

1. A road safety barrier comprising:

a series of posts spaced longitudinally along the ground, each post mounted in the ground;

an anchor body fixed in or on the ground proximate a last post of the series of posts;

at least one rope supported by the posts and extending along the series of posts, the rope having an end portion extending downwards from the last post of the series of posts towards the anchor body; and a terminal fixed on an extremity of the end portion of the rope, the terminal being connectable to the anchor body;

wherein the last post is inclined from the vertical towards the anchor body;

wherein the last post has a weakened portion at or near ground level such that the post buckles upon impact of a vehicle with the road safety barrier; and wherein the weakened portion comprises a notch in a side of the post.

2. The road safety barrier of claim 1, wherein the notch is in a flange directed towards oncoming traffic.

3. A road safety barrier comprising:

a series of posts spaced longitudinally along the ground, each post mounted in the ground;

an anchor body fixed in or on the ground proximate a last post of the series of posts;

at least one rope supported by the posts and extending along the series of posts, the rope having an end portion extending downwards from the last post of the series of posts towards the anchor body;

a terminal fixed on an extremity of the end portion of the rope, the terminal being connectable to the anchor body; and an elongate tie bar having a first end part connectable to the anchor body and a second end part releasably connected to the terminal, so that the elongate tie bar is in line with the terminal and the end portion of the rope;

wherein the last post is inclined from the vertical towards the anchor body; and wherein the anchor body has a first abutment surface facing away from the series of posts, an abutment member on the tie bar has a second abutment surface facing the first abutment surface, the abutment surfaces are urged towards each other by tension applied to the rope, and the anchor body comprises a slotted opening allowing the elongate tie bar to separate from the anchor body in a direction parallel to the first abutment surface in response to a predetermined deflection of the end portion of the rope.

4. The road safety barrier of claim 3, further comprising at least one intermediate member between the first and second abutment surfaces.

5. The road safety barrier of claim 3, wherein the second end part of the elongate tie bar carries a socket which is threaded on the terminal.

6. A road safety barrier comprising:

a series of posts spaced longitudinally along the ground, each post mounted on or in the ground such that the posts are prevented from moving along the surface of the ground;

an anchor body fixed in or on the around proximate a last post of the series of posts;

at least one rope supported by the posts and extending along the series of posts, the rope having an end portion extending downwards from the last post of the series of posts towards the anchor body; and a terminal fixed on an extremity of the end portion of the rope, the terminal being connectable to the anchor body;

wherein the last post is inclined from the vertical towards the anchor body;

wherein the last post has a weakened portion at or near ground level such that the post buckles upon impact of a vehicle with the road safety barrier; and wherein the weakened portion comprises a notch in a side of the post.

7. The road safety barrier of claim 6, wherein the notch is in a flange directed towards oncoming traffic.

8. A road safety barrier comprising:

a series of posts spaced longitudinally along the ground, each post mounted on or in the ground such that the posts are prevented from moving along the surface of the ground;

an anchor body fixed in or on the ground proximate a last post of the series of posts;

at least one rope supported by the costs and extending along the series of posts, the rope having an end portion extending downwards from the last post of the series of posts towards the anchor body;

a terminal fixed on an extremity of the end portion of the rope, the terminal being connectable to the anchor body; and an elongate tie bar having a first end part connectable to the anchor body and a second end part releasably connected to the terminal, so that the elongate tie bar is in line with the terminal and the end portion of the rope;

wherein the last post is inclined from the vertical towards the anchor body; and wherein the anchor body has a first abutment surface facing away from the series of posts, an abutment member on the tie bar has a second abutment surface facing the first abutment surface, the abutment surfaces are urged towards each other by tension applied to the rope, and the anchor body comprises a slotted opening allowing the elongate tie bar to separate from the anchor body in a direction parallel to the first abutment surface in response to a predetermined deflection of the end portion of the rope.

9. The road safety barrier of claim 8, further comprising at least one intermediate member between the first and second abutment surfaces.

10. The road safety barrier of claim 8, wherein the second end part of the elongate tie bar carries a socket which is threaded on the terminal.

* * * * *

UNITED STATES PATENT AND TRADEMARK OFFICE

CERTIFICATE OF CORRECTION

PATENT NO. : 7,367,549 B2
APPLICATION NO. : 11/213606
DATED : May 6, 2008
INVENTOR(S) : Michael Thomas Titmus It is certified that error appears in the above-identified patent and that said Letters Patent is hereby corrected as shown below:

On the Title Page, Item (57) "Abstract", line 8, please delete "(8e)" and substitute therefor --(8a)--.

On the Title Page, Item (57) "Abstract", line 16, please delete "I o" and substitute therefor --by--.

Column 5, line 12, please delete "around" and substitute therefor --ground--.

Column 6, line 3, please delete "costs" and substitute therefor --posts--.

Signed and Sealed this

Eighth Day of July, 2008

JON W. DUDAS
*Director of the United States Patent and Trademark Office*